US010829360B2

(12) United States Patent
Riis

(10) Patent No.: US 10,829,360 B2
(45) Date of Patent: Nov. 10, 2020

(54) DISPENSE HEAD WITH PRESSURE EQUALISING VALVE

(71) Applicant: MICRO MATIC A/S, Odense SV (DK)

(72) Inventor: Ken Riis, Odense SV (DK)

(73) Assignee: MICRO MATIC A/S, Odense SV (DK)

( * ) Notice: Subject to any disclaimer, the term of this patent is extended or adjusted under 35 U.S.C. 154(b) by 0 days.

(21) Appl. No.: 16/500,209

(22) PCT Filed: Apr. 18, 2018

(86) PCT No.: PCT/EP2018/059908
§ 371 (c)(1),
(2) Date: Oct. 2, 2019

(87) PCT Pub. No.: WO2018/192975
PCT Pub. Date: Oct. 25, 2018

(65) Prior Publication Data

US 2020/0062568 A1 Feb. 27, 2020

(30) Foreign Application Priority Data

Apr. 19, 2017 (EP) ..... 17166986

(51) Int. Cl.
*B67D 1/08* (2006.01)

(52) U.S. Cl.
CPC ..... *B67D 1/0831* (2013.01); *B67D 1/0839* (2013.01); *B67D 1/0845* (2013.01)

(58) Field of Classification Search
CPC ... B67D 1/0831; B67D 1/0839; B67D 1/0845
(Continued)

(56) References Cited

U.S. PATENT DOCUMENTS 3,596,809 A 8/1971 Taubenheim
5,690,136 A * 11/1997 Celli ..... B67D 1/0832 137/212

(Continued)

FOREIGN PATENT DOCUMENTS

EP 0 432 650 6/1991
EP 3 028 988 6/2016

OTHER PUBLICATIONS

International Preliminary Report on Patentability, including the Written Opinion of the International Searching Authority, dated Oct. 22, 2019 in International Application No. PCT/EP2018/059908, 8 pages.

(Continued)

*Primary Examiner* — Jeremy Carroll
(74) *Attorney, Agent, or Firm* — Nixon & Vanderhye P.C.

(57) ABSTRACT

The present invention relates to a dispense head configured to be coupled to a beverage container above a container valve arranged in the beverage container in a dispensing system, the dispense head comprising a housing having a first end and a second end, a hollow piston arranged displaceably in an axial direction within the housing, the piston being connected to a handle so that upon activation of the handle, the piston will be displaced axially towards and beyond a second end of the housing in order to open the container valve, and a gas inlet arranged in the housing, which via a fluid channel is fluidly connected with a space extending along the piston and between the housing and the piston, wherein the housing comprises an opening extending through the housing and being in fluid communication with the fluid channel, and wherein a valve is arranged in the fluid channel opposite the opening, the valve having a first position in which the gas inlet is fluidly connected with an inside of the beverage container when the piston has opened the container valve, and a second position in which the gas (Continued)

Figure 1:
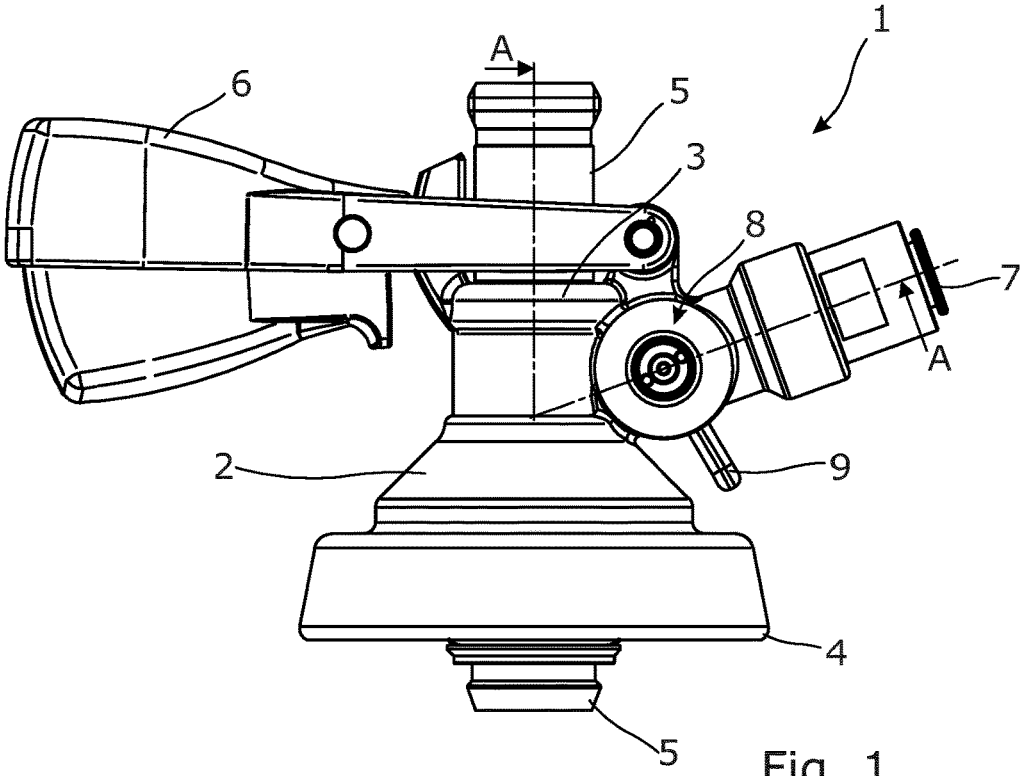

inlet is closed and the inside of the beverage container is fluidly connected with the opening so that a gas present in the beverage container may be pressure equalised with the environment before the dispense head is decoupled from the beverage container. Furthermore, the present invention relates to a dispensing system for dispensing beverage and to a method for dispensing beverage.

16 Claims, 6 Drawing Sheets

(58) Field of Classification Search
USPC ..... 200/100
See application file for complete search history.

(56) References Cited

U.S. PATENT DOCUMENTS

| | | | | |
|---|---|---|---|---|
| 2001/0045438 | A1 | 11/2001 | Bilskie et al. | |
| 2010/0252584 | A1* | 10/2010 | Celli | B67D 1/1405<br>222/400.7 |
| 2013/0008527 | A1* | 1/2013 | Gitlin, Jr. | B67D 1/0831<br>137/317 |
| 2017/0267511 | A1* | 9/2017 | Valles | B67D 1/0004 |

OTHER PUBLICATIONS

Extended European Search Report for EP Application No. 17166986.4 dated Oct. 20, 2017, 5 pages.
International Search Report and Written Opinion of the ISA for PCT/EP2018/059908 dated Jun. 25, 2018, 12 pages.

* cited by examiner

DISPENSE HEAD WITH PRESSURE EQUALISING VALVE

This application is the U.S. national phase of International Application No. PCT/EP2018/059908 filed Apr. 18, 2018 which designated the U.S. and claims priority to EP Application No. 17166986.4 filed Apr. 19, 2017, the entire contents of each of which are hereby incorporated by reference.

The present invention relates to a dispense head configured to be coupled to a beverage container above a container valve arranged in the beverage container in a dispensing system. Furthermore, the present invention relates to a dispensing system for dispensing beverage and to a method for dispensing beverage.

In recent years, there has been a tendency within the area of beverage dispensing equipment towards the incorporation of disposable parts. Such disposable parts may for instance be the equipment being in direct contact with the beverage, such as the dispensing line and the beverage container.

However, it is still common to use a gas to propel the beverage out of the beverage container, in which a residue of gas inside the beverage container will occur when the beverage container is to be replaced. Often the interior of the beverage container has an overpressure.

For the relief of the residue of gas inside the beverage container, the suppliers of the disposable beverage containers provide a tool configured to relieve the gas inside the container, i.e. remove the overpressure. However, this tool is often lost or is difficult to use, or it takes too long time to use, resulting in the gas inside the beverage container often not being relieved when a beverage container is replaced. Consequently, beverage containers with a high residual gas pressure are being disposed of. Hence, this may have the consequence that the beverage containers inadvertently explode during the subsequent handling of the disposed beverage containers.

It is an object of the present invention to wholly or partly overcome the above disadvantages and drawbacks of the prior art. More specifically, it is an object to provide a solution wherein an overpressure inside a beverage container may be equalised in an easy manner.

The above objects, together with numerous other objects, advantages and features, which will become evident from the below description, are accomplished by a solution in accordance with the present invention by a dispense head configured to be coupled to a beverage container above a container valve arranged in the beverage container in a dispensing system, the dispense head comprising:

a housing having a first end and a second end, a hollow piston arranged displaceably in an axial direction within the housing, the piston being connected to a handle so that upon activation of the handle, the piston will be displaced axially towards and beyond a second end of the housing in order to open the container valve, and a gas inlet arranged in the housing, which via a fluid channel is fluidly connected with a space extending along the piston and between the housing and the piston, wherein the housing comprises an opening extending through the housing and being in fluid communication with the fluid channel, and wherein a valve is arranged in the fluid channel opposite the opening, the valve having a first position in which the gas inlet is fluidly connected with an inside of the beverage container when the piston has opened the container valve, and a second position in which the gas inlet is closed and the inside of the beverage container is fluidly connected with the opening so that a gas present in the beverage container may be pressure equalised with the environment before the dispense head is decoupled from the beverage container.

The valve may be connected with an actuation element configured to bring the valve from the first position to the second position and vice versa.

Moreover, the actuation element may be accessible from outside the housing.

Also, the activation of the valve from the first position to the second position may be performed by rotating a valve body.

Further, the valve body may have a bore or a groove in a face of the valve body, said bore or groove fluidly connecting the gas inlet with the space in the first position of the valve, and wherein in the second position of the valve, in which the valve body has been rotated, the bore or the groove may have been moved to a position closing the gas inlet and providing fluid connection between the inside of the beverage container and the opening.

Additionally, the valve body may have a first valve channel extending through the valve body, and a second valve channel which may be substantially perpendicular to the first valve channel and extending from the first valve channel to an outside of the valve body, so that the first valve channel and the second valve channel form a T.

Moreover, a pressure relief valve may be arranged in fluid connection with the fluid channel.

Also, the pressure relief valve may be arranged opposite the valve body, whereby the pressure relief valve may be in fluid communication with the inside of the beverage container either via the first valve channel or via the second valve channel, irrespective as to whether the valve is in its first position or in its second position.

Furthermore, a gas shut-off element may be arranged in or at the fluid channel.

The shut-off element may comprise a spring element for maintaining the fluid channel closed for gas flowing in a deactivated state of the dispense head, the spring element having a predetermined spring force.

In addition, the handle may be connected to the shut-off element via a hinge.

Moreover, the hinge may be connected with the shut-off element via a valve piston, the valve piston being movable.

Further, the shut-off element may be arranged in a bore within the housing, extending from the hinge to the fluid channel, the shut-off element comprising a nut arranged around a valve piston, a spring element arranged around the valve piston and extending between a projection in a bottom part of the valve piston and the nut, and a gasket arranged around the spring element and the valve piston.

Also, the space may be an annulus extending along an exterior of the piston. The space may be arranged between an exterior of the piston and the housing.

Furthermore, a sealing may be arranged either on the housing or within the piston to radially seal off the space in an upwards direction.

Additionally, a support ring may be arranged in the housing and extend around the piston to support the axial displacement of the piston within the housing.

Moreover, the shut-off element may extend across the fluid channel.

Further, the shut-off element may be arranged directly in the fluid channel, for instance radially or axially in relation to a gas flow direction, or the shut-off element may be arranged in connection with the fluid channel, for instance in continuation of the fluid channel.

The shut-off element may be arranged inside the housing in or at the fluid channel at a distance from the piston.

The present invention further relates to a dispensing system for dispensing beverage, comprising a beverage container comprising a container valve arranged in an opening of the beverage container, the container valve having an internal spring having a spring force enabling the opening of the beverage container to be kept closed, a gas supply, a dispensing tap, and a dispense head according to the present invention.

Also, the beverage container may be fully of partly made of a polymeric material.

Additionally, the beverage container may comprise a bag which is configured to contain a beverage, and wherein the beverage in the bag may be configured to be expelled by pressurising a container space between the bag and an inner face of the beverage container.

The present invention also relates to a method for dispensing beverage from a dispensing system according to the present invention, comprising:

- coupling a dispense head according to the present invention to a beverage container opposite the container valve,
- activating the handle in order to open the container valve,
- providing the valve of the dispense head in the first position,
- opening the dispensing tap for dispensing the beverage by letting gas into the beverage container through the dispense head,
- providing the valve of the dispense head in the second position in order to pressure equalise the gas pressure present in the beverage container to the environment,
- deactivating the handle in order to close the container valve, and
- decoupling the dispense head from the beverage container.

The opening of the dispensing tap for dispensing beverage may be performed several times until either the beverage container is empty and/or the beverage container is to be replaced.

Furthermore, the present invention relates to a method for equalising a pressure in a beverage container, comprising:

- coupling a dispense head according to the present invention to a beverage container opposite the container valve,
- activating the handle in order to open the container valve,
- providing the valve of the dispense head in the second position for equalising the gas present in the beverage container to the environment via the opening in the housing of the dispense head,
- deactivating the handle in order to close the container valve, and
- decoupling the dispense head from the beverage container.

Figure 4:
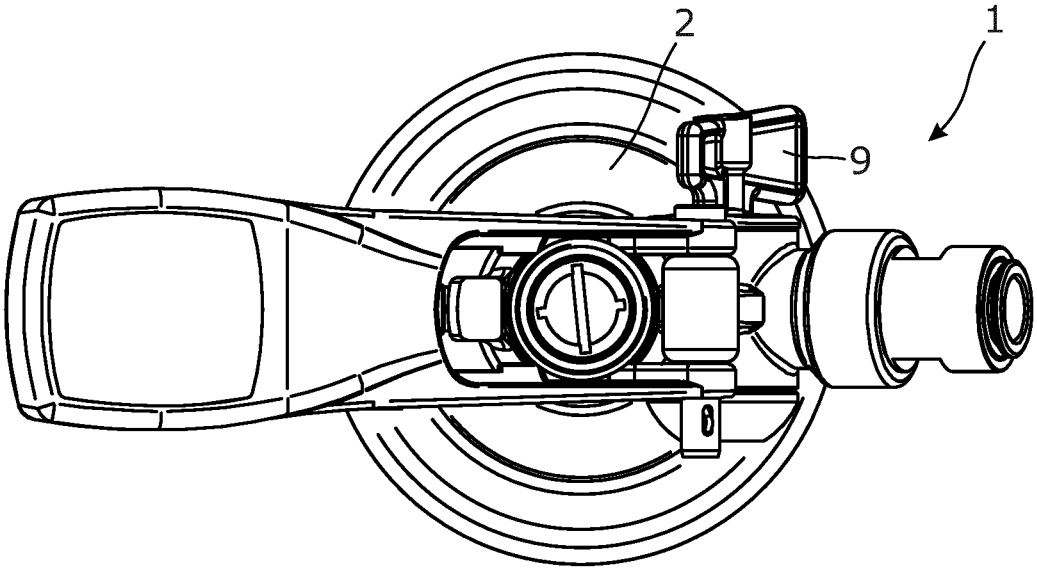
Figure 5:
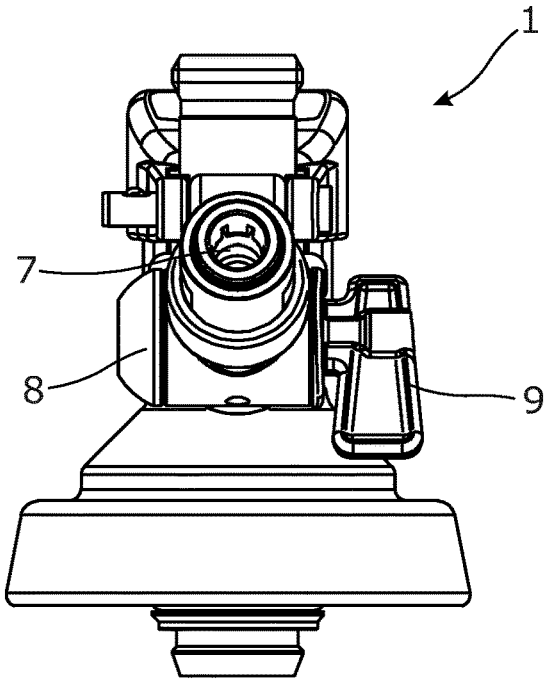
Figure 6:
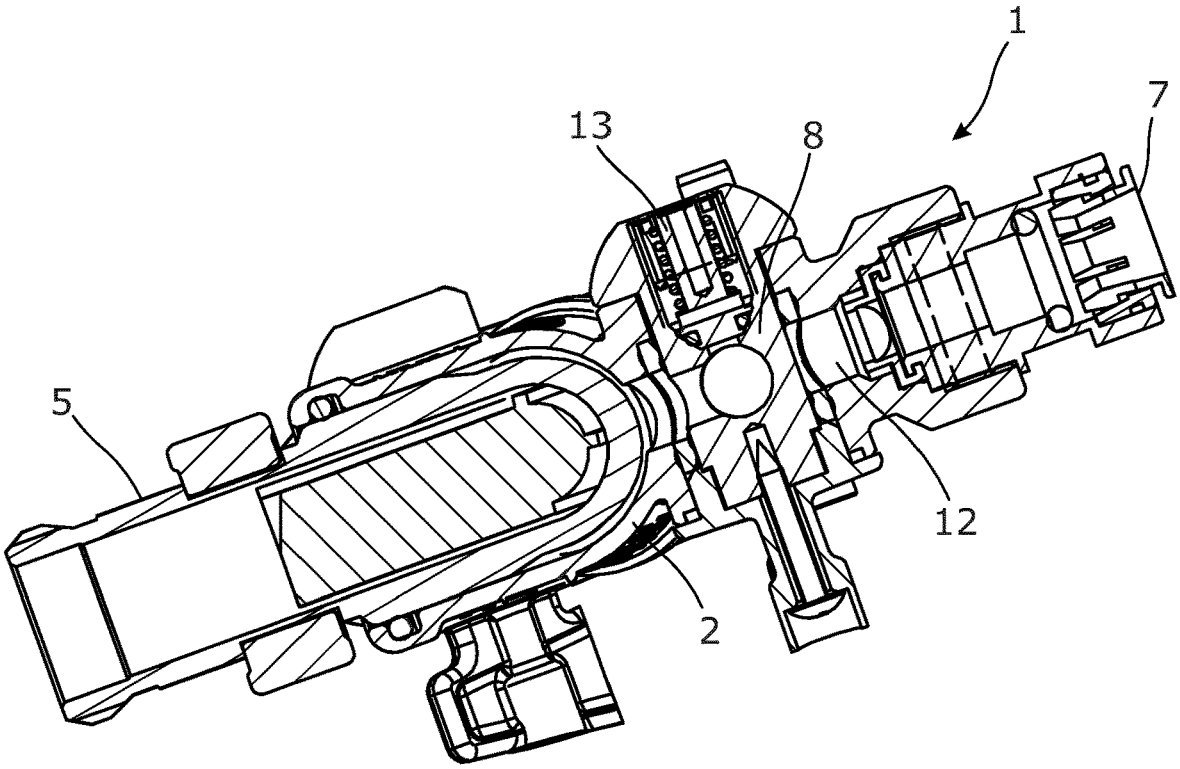
Figure 7:
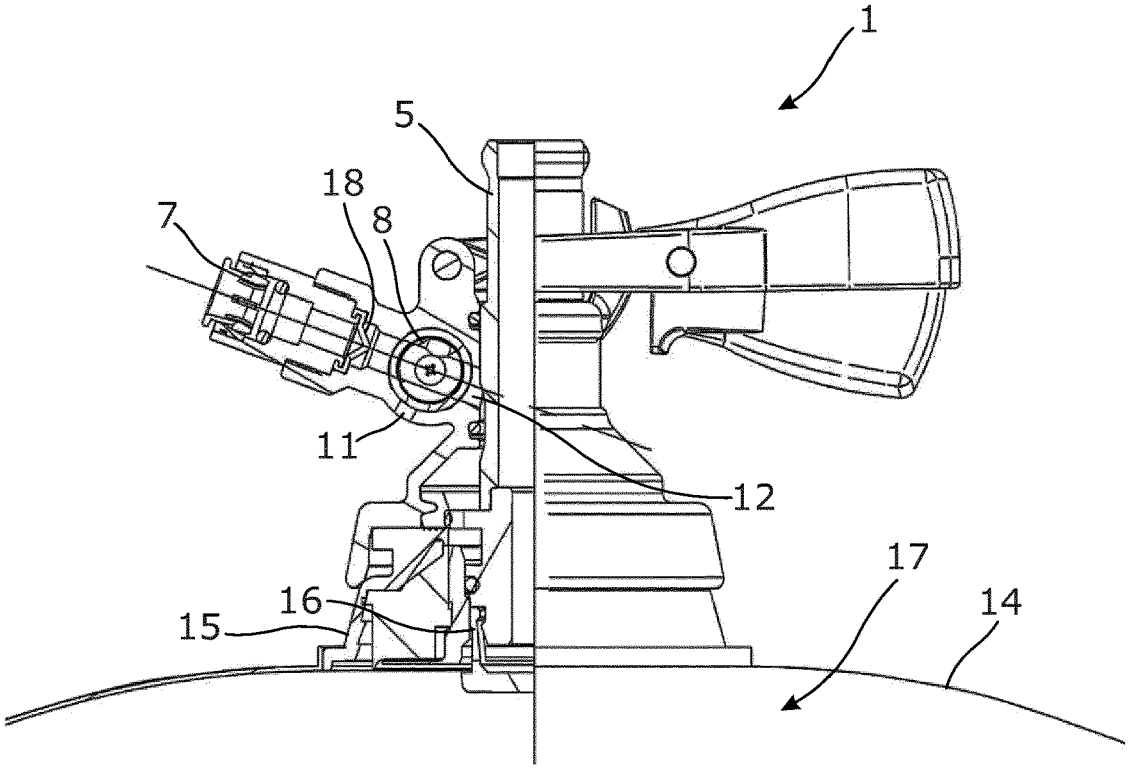
Figure 8:
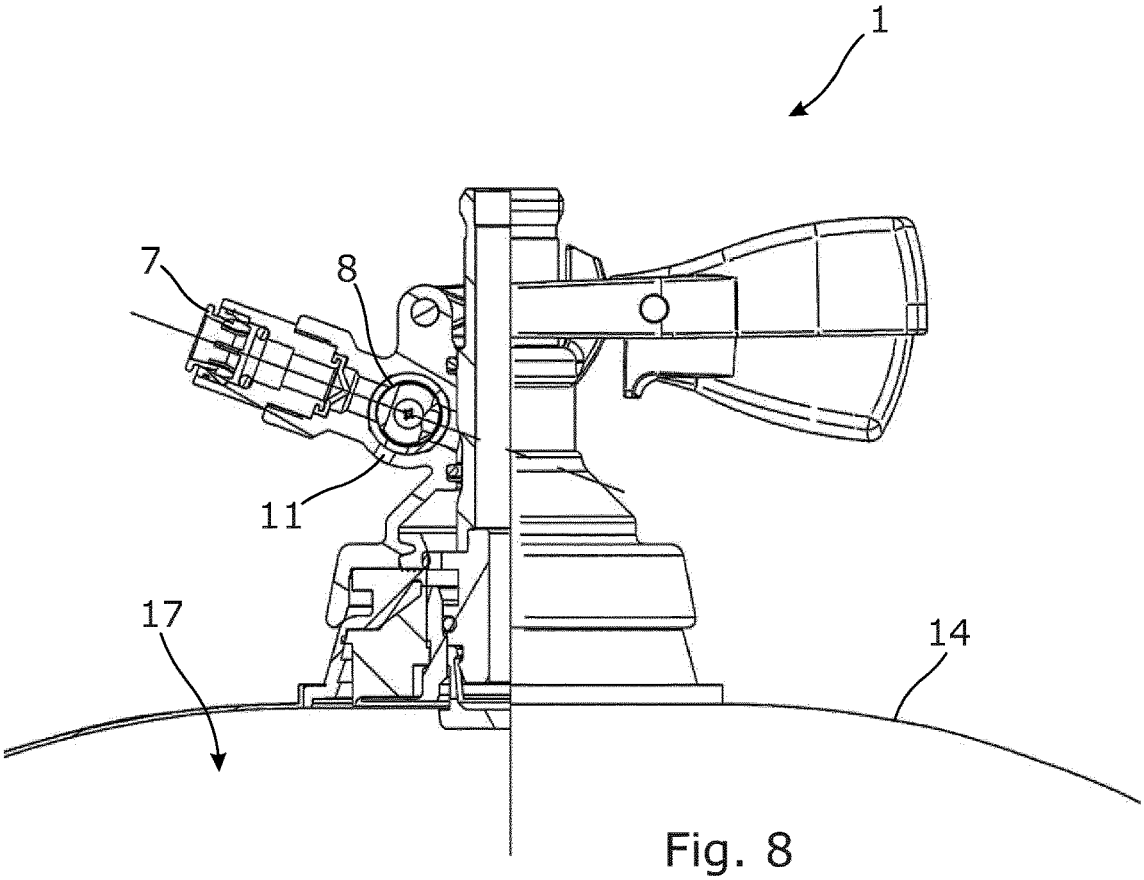
Figure 9:
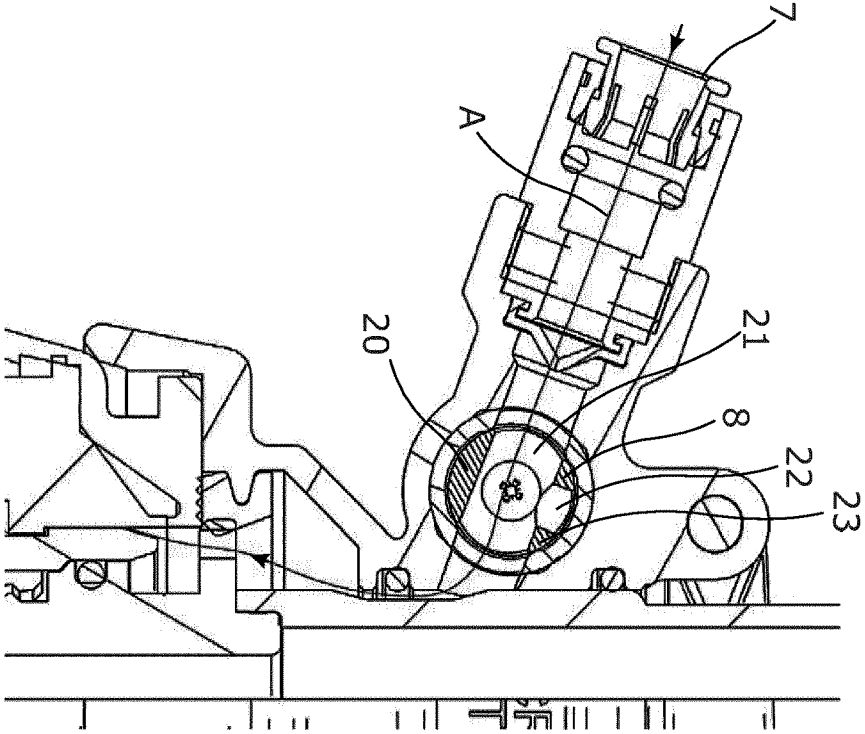
Figure 10:
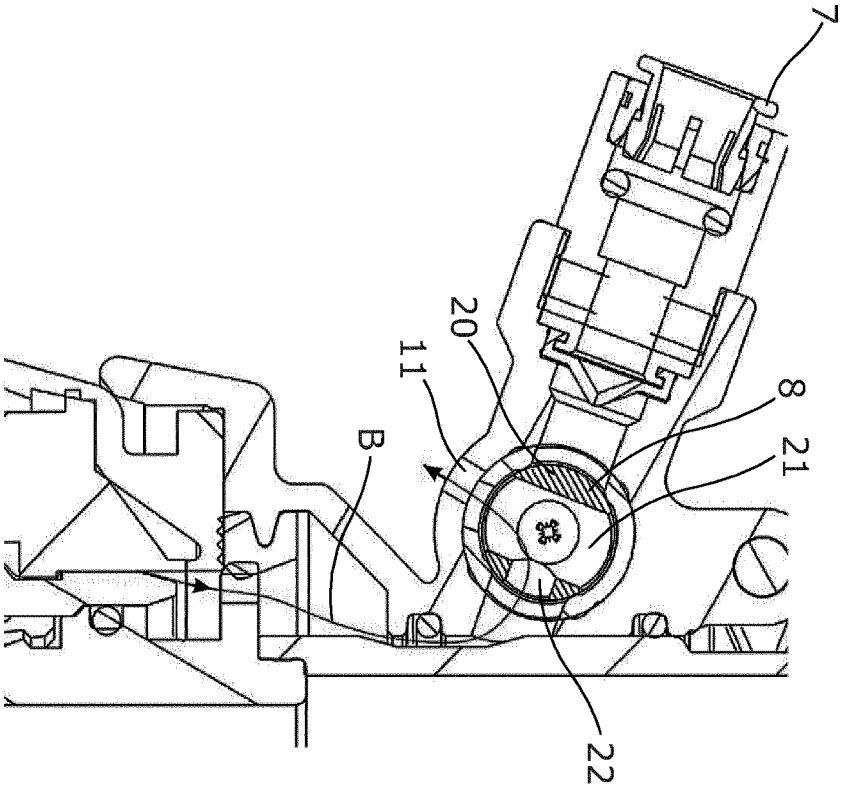
Figure 11:
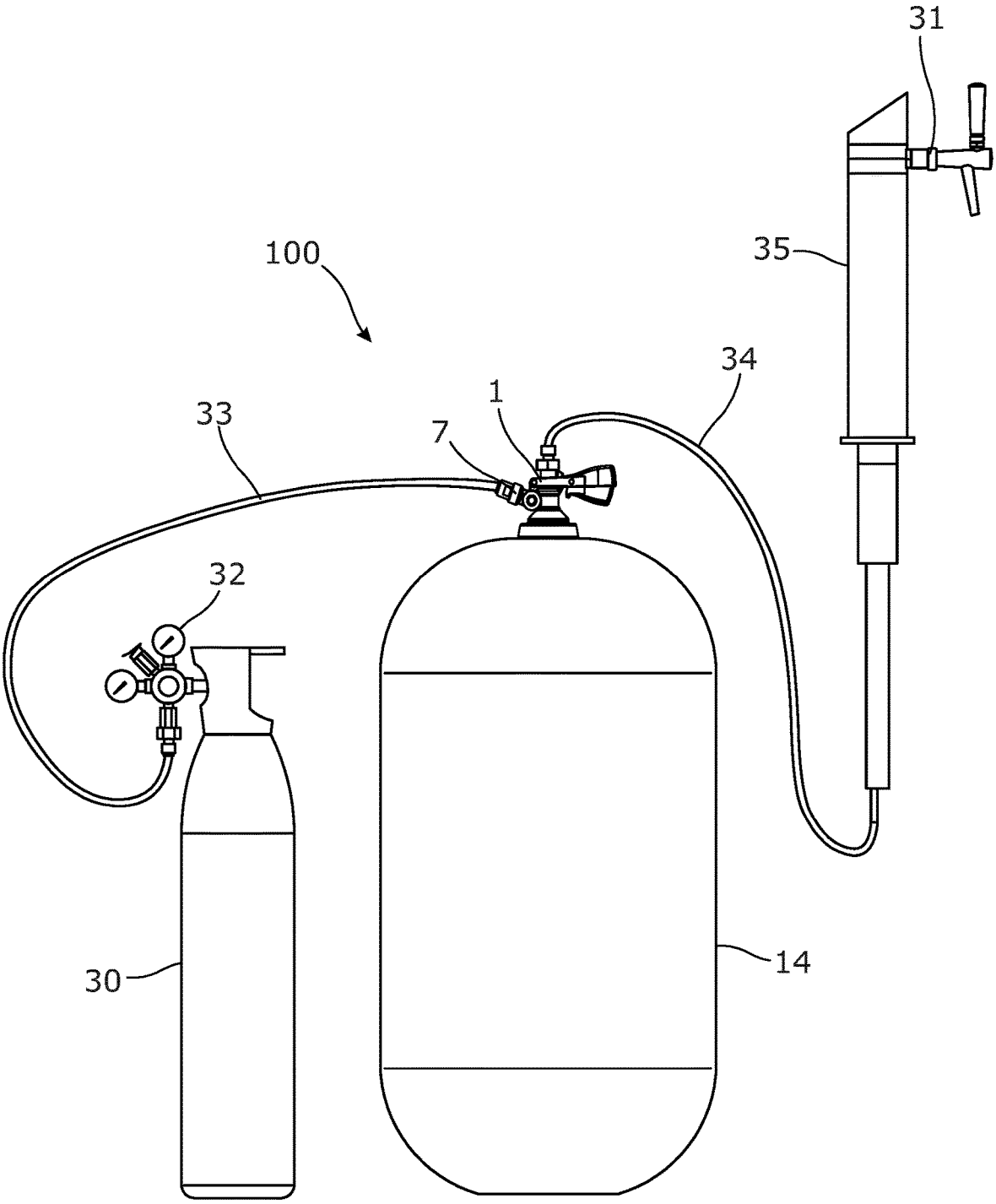

The invention and its many advantages will be described in more detail below with reference to the accompanying schematic drawings, which for the purpose of illustration show some non-limiting embodiments and in which:

FIGS. 1-5 show different views of a dispense head according to the present invention, FIG. 6 is a cross-sectional view taken along the A-A line of the dispense head shown in FIG. 1, FIG. 7 is a partly cross-sectional view of a dispense head disclosing a first position of the valve, FIG. 8 is a partly cross-sectional view of a dispense head disclosing a second position of the valve, FIG. 9 is an enlarged cross-sectional view of the valve in the first position, FIG. 10 is an enlarged cross-sectional view of the valve in the second position, and FIG. 11 shows a dispensing system according to the invention.

All the figures are highly schematic and not necessarily to scale, and they show only those parts which are necessary in order to elucidate the invention, other parts being omitted or merely suggested.

FIGS. 1 to 5 show an embodiment of a dispense head 1 according to the invention in different views. The dispense head in FIG. 1 comprises a housing 2 having a first end 3 and a second end 4. The dispense head 1 also comprises a hollow piston 5 arranged displaceably in the axial direction within the housing 2, the piston 5 being connected to a handle 6, so that upon activation of the handle 6, the piston 5 will be displaced axially towards and beyond the second end 4 of the housing 2 in order to open a container valve (not shown) of a beverage container (not shown). In FIG. 1, the piston has been moved to the position in which it extends beyond the second end 4 of the housing 2 by means of the handle 6. In addition, the dispense head 1 comprises a gas inlet 7 arranged in the housing 2. Further, the dispense head 1 comprises a valve 8 which, in the embodiment shown, has an actuation element 9 accessible from the outside of the housing 2.

Figure 2:
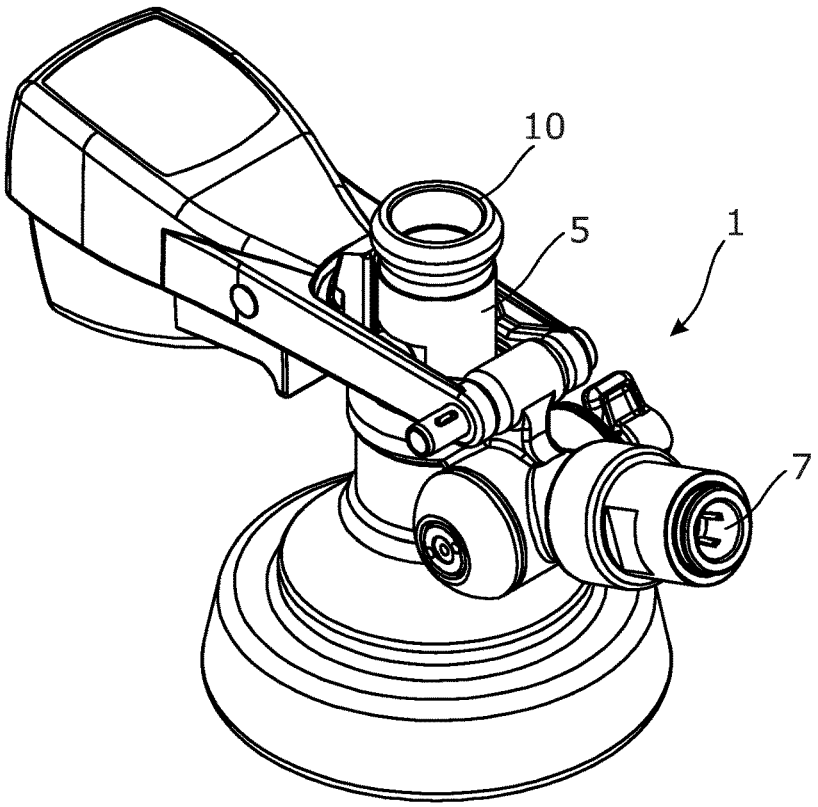

In FIG. 2, the dispense head 1 is shown in a perspective view. A top 10 of the piston 5 is configured to be connected with a dispensing line (not shown). In other not shown embodiments, the dispensing line may be connected with the piston in other expedient manners. The gas inlet 7 is configured to be connected with a gas supply (not shown).

Figure 3:
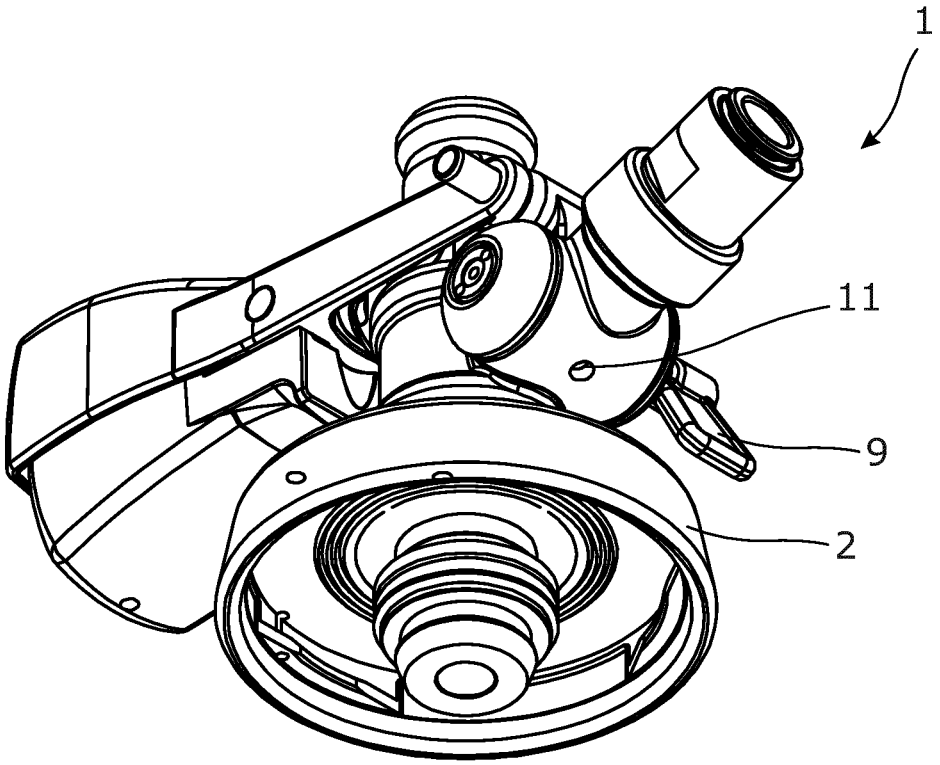

In FIG. 3, the dispense head 1 is shown in a perspective view from below. The housing 2 has an opening 11 which extends from the outside of the housing to a fluid channel (not shown) inside the housing 2. In addition, the actuation element 9 is shown.

In FIG. 4, the dispense head 1 is shown in a top view in which the actuation element 9 is in a position outside the housing 2 which is easily accessible for a user.

FIG. 5 shows the dispense head 1 in a side view from the gas inlet 7 side. Again the actuation element 9 for operating the valve 8 is shown.

FIG. 6 is a partly cross-sectional view taken through the A-A line of FIG. 1. The dispense head 1 comprises the gas inlet 7 which, via a fluid channel 12, is fluidly connected with a space (not shown) extending along the piston 5 and between the housing 2 and the piston 5. The housing 2 also comprises an opening (shown in FIG. 3) extending through the housing 2 and being in fluid communication with the fluid channel 12, and a valve 8 is arranged in the fluid channel opposite the opening.

The valve 8 has a first position in which the gas inlet 7 is fluidly connected with an inside of the beverage container when the piston 5 has opened the container valve, and a second position (shown in FIG. 6) in which the gas inlet 7 is closed and the inside of the beverage container is fluidly connected with the opening, so that a gas present in the beverage container may be pressure equalised with the environment before the dispense head 1 is decoupled from the beverage container. The actuation element 9 is configured to bring the valve 8 from the first position to the second position and vice versa.

In addition, a pressure relief valve 13 is arranged in fluid connection with the fluid channel 12.

FIG. 7 shows the dispense head 1 coupled to a beverage container 14. The left side of the dispense head is shown in a cross-sectional view, while the right side of the dispense head 1 is shown from the outside. The dispense head 1 is coupled to the beverage container 14 via a collar 15 which surrounds a container valve 16. The container valve 16 is configured to be opened by pressing it downwards into the beverage container 14 by means of the piston 5 of the dispense head 1. Hereby, the container valve 16 opens up for beverage to flow out of the beverage container 14 via the hollow piston 5 by pressurising the inside of the beverage container with a gas from the gas inlet 7, as is well known in the art.

As mentioned above, the dispense head 1 has a valve 8 arranged in the fluid channel 12 opposite the opening 11, the valve 8 having a first position (shown in FIG. 7) in which the gas inlet 7 is fluidly connected with an inside 17 of the beverage container 14 when the piston 5 has opened the container valve 16. In this first position, the valve 8 closes off the opening 11 so that all gas from the gas inlet 7 is led to the inside 17 of the beverage container 14.

In addition, the fluid channel 12 may also comprise a check valve 18 ensuring that gas will not inadvertently flow out of the gas inlet.

FIG. 8 shows, in same manner as FIG. 7, that the dispense head 1 is coupled to the beverage container 14. The left side of the dispense head is shown in a cross-sectional view, while the right side of the dispense head 1 is shown from the outside.

The valve 8 is in FIG. 8 moved to the second position in which the gas inlet 7 is closed and the inside 17 of the beverage container 14 is fluidly connected with the opening 11, so that a gas present in the beverage container 14 may be pressure equalised with the environment before the dispense head 1 is decoupled from the beverage container 14.

By incorporating the valve 8 into the dispense head 1, a simple way of pressure equalising the inside of the beverage container without use of an additional tool is obtained. When the user, for instance bar staff, uses the dispense head 1 according to the present invention, they simply move the valve 8 from the first position to the second position when they are to replace a beverage container. Then in a short period of time, i.e. a few seconds, the inside of the beverage container has been pressure equalised with the environment, whereby the beverage container may be disposed of without the risk of exploding due to high overpressure. Furthermore, since the valve 8 is part of the equipment, i.e. the dispense head 1, the user will already be familiar with the use thereof, and hence it is more likely that the user will remember to pressure equalise the beverage container and in fact do it rather than what is experienced with the known solutions.

The activation of the valve 8 from the first position to the second position may be performed by rotating a valve body 20. FIG. 9 is an enlarged view of the first position of the valve 8 shown in FIG. 7.

In this embodiment, the valve body 20 has a first valve channel 21 extending through the valve body 20, and a second valve channel 22 being substantially perpendicular to the first valve channel 21 and extending from the first valve channel 21 to an outside 23 of the valve body 20, so that the first valve channel 21 and the second valve channel 22 form a T. In FIG. 9, the flow of gas from the gas inlet 7 is indicated with the arrowed line A.

FIG. 10 is an enlarged view of the second position of the valve 8 shown in FIG. 8. The flow of gas from inside the beverage container to the opening 11 is indicated with the arrowed line B. The valve body 20 of the valve 8 has been rotated 90 degrees to the right (in relation to the first position of the valve 8), so that the gas inlet 7 has been closed and the inside of the beverage container is in fluid connection with the opening 11 via the second valve channel 22 and the first valve channel 21, causing a direct flow path from the inside of the beverage container to the environment (via the opening 11) to be established, in which an overpressure inside the beverage container is equalised to the pressure in the environment.

In addition, the pressure relief valve may be arranged opposite the valve body, whereby the pressure relief valve is in fluid communication with the inside of the beverage container either via the first valve channel or via the second valve channel, irrespective as to whether the valve 8 is in its first position or in its second position.

In another not shown embodiment, the valve body may have a bore or a groove in a face of the valve body fluidly connecting the gas inlet with the space in the first position of the valve, and in the second position of the valve, in which the valve body has been rotated. The bore or the groove has been moved to a position closing the gas inlet and providing fluid connection between the inside of the beverage container and the opening.

To avoid unintended gas leaks when the dispense head not is coupled to the beverage container but the handle is activated, a gas shut-off element (not shown) may be arranged in or at the fluid channel. The shut-off element may comprise a spring element for maintaining the fluid channel closed for gas flowing in a deactivated state of the dispense head, the spring element having a predetermined spring force.

In addition, the handle of the dispense head may be connected to the shut-off element via a hinge. The hinge may then be connected with the shut-off element via a valve piston, the valve piston being movable. The shut-off element may be arranged in a bore within the housing, extending from the hinge to the fluid channel, the shut-off element comprising a nut arranged around a valve piston, a spring element arranged around the valve piston and extending between a projection in a bottom part of the valve piston and the nut, and a gasket arranged around the spring element and the valve piston.

Furthermore, the space may be an annulus extending along an exterior of the piston. The space may be arranged between an exterior of the piston and the inside of the housing.

Moreover, a sealing may be arranged either on the housing or within the piston to radially seal off the space in an upwards direction.

A support ring may be arranged in the housing and it may extend around the piston to support the axial displacement of the piston within the housing.

The shut-off element may extend across the fluid channel.

The shut-off element may also be arranged directly in the fluid channel, for instance radially or axially in relation to a gas flow direction, or the shut-off element may be arranged in connection with the fluid channel, for instance in continuation of the fluid channel.

In another embodiment, the shut-off element may be arranged inside the housing in or at the fluid channel at a distance from the piston.

In FIG. 11, a dispensing system 100 for dispensing beverage is shown. The dispensing system 100 comprises a beverage container 14 comprising a container valve arranged in an opening of the beverage container, the container valve having an internal spring with a spring force enabling the opening of the beverage container 14 to be kept closed, a gas supply 30, a dispensing tap 31, and a dispense head 1. The gas supply 30 is connected with the gas inlet 7 of the dispense head 1 via a gas regulator 32 and a gas supply line 33. From the dispense head 1 to the dispensing tap 31, a dispensing line 34 extends. The dispensing line 34 may be configured to be guided from the dispense head 1 to the dispensing tap 31 via the tower 35 or from the dispensing tap 31 via the tower 35 to the dispense head 1, so that the dispensing line 34 may be replaced each time the beverage container 14 is replaced.

The beverage container 14 may be fully of partly made of a polymeric material.

Also, the beverage container 14 may comprise a bag which is configured to contain a beverage, and the beverage in the bag is configured to be expelled by pressurising a container space between the bag and an inner face of the beverage container.

When the user is to dispense beverage, he or she may use the following method according to the present invention:

- coupling a dispense head 1 as described above to a beverage container 14 opposite the container valve 16,
- activating the handle 6 of the dispense head 1 in order to open the container valve 16,
- providing the valve 8 of the dispense head in the first position,
- opening the dispensing tap 31 for dispensing the beverage by letting gas into the beverage container 14 through the dispense head 1,
- providing the valve 8 of the dispense head in the second position in order to pressure equalise the gas present in the beverage container 14 to the environment,
- deactivating the handle 6 of the dispense head 1 in order to close the container valve 16, and
- decoupling the dispense head 1 from the beverage container 14.

The user may open the dispensing tap 31 for dispensing beverage several times until either the beverage container is empty and/or the beverage container is to be replaced, before providing the valve in the second position.

Hence, the user may equalise a pressure in a beverage container, by

- coupling a dispense head 1 as mentioned above to a beverage container 14 opposite the container valve 16,
- activating the handle 6 of the dispense head 1 in order to open the container valve,
- providing the valve 8 of the dispense head in the second position for equalising the gas present in the beverage container to the environment via the opening 11 in the housing 2 of the dispense head 1,
- deactivating the handle 6 in order to close the container valve, and
- decoupling the dispense head 1 from the beverage container 14.

Although the invention has been described in the above in connection with preferred embodiments of the invention, it will be evident for a person skilled in the art that several modifications are conceivable without departing from the invention as defined by the following claims.

The invention claimed is:

1. A dispense head configured to be coupled to a beverage container above a container valve arranged in the beverage container in a dispensing system, the dispense head comprising:

- a housing having a first end and a second end,
- a hollow piston arranged displaceably in an axial direction within the housing, the piston being connected to a handle so that upon activation of the handle, the piston will be displaced axially towards and beyond a second end of the housing in order to open the container valve, and
- a gas inlet arranged in the housing, which via a fluid channel is fluidly connected with a space extending along the piston and between the housing and the piston,
- wherein the housing comprises an opening extending through the housing and being in fluid communication with the fluid channel, and
- wherein a valve is arranged in the fluid channel opposite the opening, the valve having
  - a first position in which the gas inlet is fluidly connected with an inside of the beverage container when the piston has opened the container valve, and
  - a second position in which the gas inlet is closed and the inside of the beverage container is fluidly connected with the opening so that a gas present in the beverage container may be pressure equalised with the environment before the dispense head is decoupled from the beverage container.

2. A dispense head according to claim 1, wherein the valve is connected with an actuation element configured to bring the valve from the first position to the second position and vice versa.

3. A dispense head according to claim 2, wherein the actuation element is accessible from outside of the housing.

4. A dispense head according to claim 1, wherein the activation of the valve from the first position to the second position is performed by rotating a valve body.

5. A dispense head according to claim 4, wherein the valve body has a bore or a groove in a face of the valve body, said bore or groove fluidly connecting the gas inlet with the space in the first position of the valve, and wherein in the second position of the valve, in which the valve body has been rotated, the bore or the groove has been moved to a position closing the gas inlet and providing fluid connection between the inside of the beverage container and the opening.

6. A dispense head according to claim 4, wherein the valve body has a first valve channel extending through the valve body, and a second valve channel which is substantially perpendicular to the first valve channel and extending from the first valve channel to an outside of the valve body, so that the first valve channel and the second valve channel form a T.

7. A dispense head according to claim 1, wherein a pressure relief valve is arranged in fluid connection with the fluid channel.

8. A dispense head according to claim 7, wherein the pressure relief valve is arranged opposite the valve body, whereby the pressure relief valve is in fluid communication with the inside of the beverage container either via the first valve channel or via the second valve channel, irrespective as to whether the valve is in its first position or in its second position.

9. A dispense head according to claim 1, wherein a gas shut-off element is arranged in or at the fluid channel.

10. A dispense head according to claim 9, wherein the shut-off element comprises a spring element for maintaining the fluid channel closed for gas flowing in a deactivated state of the dispense head, the spring element having a predetermined spring force.

11. A dispense head according to claim 9, wherein the handle is connected to the shut-off element via a hinge.

12. A dispensing system for dispensing beverage, comprising a beverage container comprising a container valve arranged in an opening of the beverage container, the container valve having an internal spring having a spring force enabling the opening of the beverage container to be kept closed, a gas supply, a dispensing tap, and a dispense head according to claim 1.

13. A dispensing system according to claim 12, wherein the beverage container is fully of partly made of a polymeric material.

14. A dispensing system according to claim 12, wherein the beverage container comprises a bag which is configured to contain a beverage, and wherein the beverage in the bag is configured to be expelled by pressurising a container space between the bag and an inner face of the beverage container.

15. A method for dispensing beverage from a dispensing system according to claim 12, comprising:

coupling a dispense head to a beverage container opposite the container valve, activating the handle in order to open the container valve, providing the valve of the dispense head in the first position, opening the dispensing tap for dispensing the beverage by letting gas into the beverage container through the dispense head, providing the valve of the dispense head in the second position in order to pressure equalise the gas pressure present in the beverage container to the environment, deactivating the handle in order to close the container valve, and decoupling the dispense head from the beverage container.

16. A method for equalising a pressure in a beverage container, comprising:

coupling a dispense head according to claim 1 to a beverage container opposite a container valve, activating the handle in order to open the container valve, providing the valve of the dispense head in the second position for equalising the gas present in the beverage container to the environment via the opening in the housing of the dispense head, deactivating the handle in order to close the container valve, and decoupling the dispense head from the beverage container.

* * * * *